US010902764B2

(12) United States Patent
Chen

(10) Patent No.: US 10,902,764 B2
(45) Date of Patent: Jan. 26, 2021

(54) SYSTEM AND METHOD FOR DRIVING THREE-COLOR AND FOUR-COLOR PIXEL DISPLAY PANEL

(71) Applicants: HKC CORPORATION LIMITED, Shenzhen (CN); CHONGQING HKC OPTOELECTRONICS TECHNOLOGY CO., LTD., Chongqing (CN)

(72) Inventor: Wei Chen, Chongqing (CN)

( * ) Notice: Subject to any disclaimer, the term of this patent is extended or adjusted under 35 U.S.C. 154(b) by 0 days.

(21) Appl. No.: 16/327,327

(22) PCT Filed: Sep. 7, 2018

(86) PCT No.: PCT/CN2018/104538
§ 371 (c)(1),
(2) Date: Feb. 22, 2019

(87) PCT Pub. No.: WO2019/085645
PCT Pub. Date: May 9, 2019

(65) Prior Publication Data

US 2020/0258440 A1 Aug. 13, 2020

(30) Foreign Application Priority Data

Nov. 3, 2017 (CN) ..... 2017 1 1073100

(51) Int. Cl.
*G09G 3/20* (2006.01)

(52) U.S. Cl.
CPC ... *G09G 3/2003* (2013.01); *G09G 2300/0452* (2013.01)

(58) Field of Classification Search
CPC ..... G09G 3/2003; G09G 2300/0452
See application file for complete search history.

(56) References Cited

U.S. PATENT DOCUMENTS

2006/0268003 A1 11/2006 Tanase et al.
2017/0270843 A1* 9/2017 Lee ..... G09G 3/2003
2018/0322832 A1* 11/2018 Zhao ..... G09G 5/02

FOREIGN PATENT DOCUMENTS

CN 1901019 A 1/2007
CN 101510420 A 8/2009
CN 101702304 A 5/2010
CN 103927999 A 7/2014
CN 107886896 A 4/2018

* cited by examiner

*Primary Examiner* — Charles V Hicks
(74) *Attorney, Agent, or Firm* — Kilpatrick Townsend & Stockton, LLP

(57) ABSTRACT

The present application relates to a system and method for driving a three-color and four-color pixel display panel, including: providing a three-color pixel display panel; connecting the three-color pixel display panel to a driver; generating, by the driver, a fourth color sub-pixel according to grayscale values of three color sub-pixels to convert the three-color pixel display panel to a four-color pixel display panel; converting, by the driver, each two adjacent pixel units to one pixel unit, and each two adjacent fourth color sub-pixels to one fourth color sub-pixel; and converting, by the driver, each fourth color sub-pixel back to the first color sub-pixel, the second color sub-pixel and the third color sub-pixel, so as to convert the four-color pixel display panel back to the three-color pixel display panel.

19 Claims, 5 Drawing Sheets

SYSTEM AND METHOD FOR DRIVING THREE-COLOR AND FOUR-COLOR PIXEL DISPLAY PANEL

CROSS-REFERENCE TO RELATED APPLICATIONS

This application is a U.S. national Stage of International Application No. PCT/CN2018/104538, filed on Sep. 7, 2018, designating the United States, which claims priority to Chinese Patent Application No. 201711073100.7, filed with the Chinese Patent Office on Nov. 3, 2017 and entitled "SYSTEM AND METHOD FOR DRIVING THREE-COLOR AND FOUR-COLOR PIXEL DISPLAY PANEL", the content of each of which is hereby incorporated by reference in its entirety.

FIELD

The present application relates to a display panel, and in particular, to a system and method for driving a three-color and four-color pixel display panel, with which a compatible effect can be realized only by changing a driving circuit configuration of the panel in a premise that the design of the display panel is maintain unchanged.

BACKGROUND

At present, in a display device having, for example, a liquid crystal display panel or an organic light emitting diode (OLED) display panel, a pixel unit usually consists of a red sub-pixel (R), a green sub-pixel (G), and a blue sub-pixel (B). The color to be displayed on the display panel is mixed by controlling the R data of the red sub-pixel, the G data of the green sub-pixel and the B data of the blue sub-pixel to display a color image.

With the development of information technology, various demands for the display panel are also increasing. High transmittance, low power consumption, and good image quality become a demand for display panels. The existing RGB three primary color mixed light display mode has a low transmittance and a low mixing efficiency, resulting in a large power consumption of the display panel, which restricts the optimization of the display panel. Based on the above, a display panel having a four-pixel unit consisting of red sub-pixels (R), green sub-pixels (G) and blue sub-pixels (B) and white sub-pixels (W) has appeared, thereby improving the display quality of the display panel based on the three-pixel.

However, with the enhancement of people's consciousness of energy saving and emission reduction, the energy saving advantage of RGBW technology becomes increasingly important and prominent. The RGBW technology brings a good experience of high brightness, high contrast under the white picture, 30%~50% energy saving and so on to the consumers, and at the same time, it also brings a huge investment to the LCD panel manufacturers. Comparing with an RGB panel, the existing four-color pixel display panel further needs to introduce white pixel points, and thus the corresponding manufacturing equipment needs to be modified accordingly. Further, the mask of the RGB panel is not applicable to the existing four-color pixel display panel, resulting in a large investment in material development, human development and productivity.

SUMMARY

In view of the above problems of the prior art, it is an objective of the present application to provide a system and method for driving a three-color and four-color pixel display panel, with which the compatibility of the three-color and four-color pixel display panel can be realized only by changing a driving circuit configuration of the panel without changing the design of the display panel, so as to solve the defects of the prior art.

Based on the above objective, the present application provides a method for driving a three-color and four-color pixel display panel, including: providing a three-color pixel display panel, the display panel including a plurality of pixel units arranged in an array, each of the pixel units including a first color sub-pixel, a second color sub-pixel, and a third color sub-pixel; connecting the three-color pixel display panel to the driver; generating, by a driver, a fourth color sub-pixel according to grayscale values of the first color sub-pixel, the second color sub-pixel and the third color sub-pixel, and the fourth color sub-pixel is arranged with the first color sub-pixel, the second color sub-pixel and the third color sub-pixel to convert the three-color pixel display panel to a four-color pixel display panel; converting, by the driver, each two adjacent pixel units to one pixel unit, and each two adjacent fourth color sub-pixels to one fourth color sub-pixel; and converting, by the driver, each fourth color sub-pixel back to the first color sub-pixel, the second color sub-pixel and the third color sub-pixel, so as to convert the four-color pixel display panel back to the three-color pixel display panel.

Optionally, the step of converting, by the driver, each two adjacent pixel units to one pixel unit, and each two adjacent fourth color sub-pixels to one fourth color sub-pixel and/or the step of converting, by the driver, each fourth color sub-pixel back to the first color sub-pixel, the second color sub-pixel and the third color sub-pixel includes using a Sub-Pixel Rendering (SPR) algorithm.

Optionally, after the step of generating, by a driver, a fourth color sub-pixel according to grayscale values of the first color sub-pixel, the second color sub-pixel and the third color sub-pixel, the method further includes arranging the fourth color sub-pixels between each two adjacent pixel units of the three-color pixel display panel, so as to convert the three-color pixel display panel to the four-color pixel display panel.

Optionally, the method for driving a three-color and four-color pixel display panel further includes: calculating, by a timing controller, the grayscale value of the first color sub-pixel, the second color sub-pixel and the third color sub-pixel; generating, by the driver, the fourth color sub-pixel according to the grayscale value calculated by the timing controller; and outputting, by the timing controller, a driving control signal to the driver, so as to control a time point for the driver to generate the fourth color sub-pixel and to convert the three-color pixel display panel to the four-color pixel display panel or convert the four-color pixel display panel back to the three-color pixel display panel.

Based on the above objective, the present application further provides a method for driving a three-color and four-color pixel display panel, including: providing a three-color pixel display panel, the display panel including a plurality of pixel units arranged in an array, each of the pixel units including the first color sub-pixel, the second color sub-pixel, and the third color sub-pixel; connecting the three-color pixel display panel to the driver; determining, by a timing controller, whether to convert the three-color pixel display panel at a current time point, if not, repeating this step, and if yes, executing the subsequent steps; outputting, by the timing controller, a first driving control signal to the driver; generating, by a driver, a fourth color sub-pixel based on the first driving control signal according to grayscale values of the first color sub-pixel, the second color sub-pixel and the third color sub-pixel, and arranging the fourth color sub-pixels between each two adjacent pixel units of the three-color pixel display panel, so as to convert the three-color pixel display panel to the four-color pixel display panel; determining, by a timing controller, whether to convert the four-color pixel display panel at a current time point, if not, repeating this step, and if yes, executing the subsequent steps; outputting, by the timing controller, a second driving control signal to the driver; converting, by the driver, each two adjacent pixel units to one pixel unit, and each two adjacent fourth color sub-pixels to one fourth color sub-pixel based on the second driving control signal; and converting, by the driver, each fourth color sub-pixel back to the first color sub-pixel, the second color sub-pixel and the third color sub-pixel, so as to convert the four-color pixel display panel back to the three-color pixel display panel.

Based on the above objective, the present application further provides a system for driving a three-color and four-color pixel display panel. The system includes: a three-color pixel display panel, including a plurality of pixel units arranged in an array, each pixel unit including the first color sub-pixel, the second color sub-pixel, and the third color sub-pixel; and a driver connecting the three-color pixel display panel, and the driver generates a fourth color sub-pixel according to grayscale values of the first color sub-pixel, the second color sub-pixel and the third color sub-pixel, and the fourth color sub-pixel is arranged with the first color sub-pixel, the second color sub-pixel and the third color sub-pixel to convert the three-color pixel display panel to a four-color pixel display panel; and the driver then converts each two adjacent pixel units to one pixel unit, and converts each two adjacent fourth color sub-pixels to one fourth color sub-pixel; and then the driver converts each fourth color sub-pixel back to the first color sub-pixel, the second color sub-pixel and the third color sub-pixel, so as to convert the four-color pixel display panel back to the three-color pixel display panel.

Optionally, in the three-color pixel display panel, the first color sub-pixel, the second color sub-pixel, and the third color sub-pixel in the pixel unit of a same row are arranged in a horizontal direction in a same order.

Optionally, the four-color pixel display panel includes a plurality of odd-numbered pixel rows and a plurality of even-numbered pixel rows, and an arranging order of the first color sub-pixel, the second color sub-pixel, the third color sub-pixel and the fourth color sub-pixel in each pixel unit of the plurality of odd-numbered sub-pixel rows of the four-color pixel display panel is different from an arranging order of the first color sub-pixel, the second color sub-pixel, the third color sub-pixel and the fourth color sub-pixel in each pixel unit of the plurality of even-numbered sub-pixel rows of the four-color pixel display panel.

Optionally, in the pixel unit of the four-color pixel display panel, the first color sub-pixel, the second color sub-pixel, the third color sub-pixel, and the fourth color sub-pixel are arranged sequentially in the horizontal direction from left to right.

Optionally, the system further includes a timing controller connecting the driver, and the timing controller outputs a driving control signal to the driver, so as to control a time point for the driver to convert the three-color pixel display panel to the four-color pixel display panel or convert the four-color pixel display panel back to the three-color pixel display panel.

Optionally, the three-color pixel display panel and the four-color pixel display panel are liquid crystal displays, plasma displays, organic light emitting displays, or field emission displays.

Optionally, the colors of the first color sub-pixel, the second color sub-pixel, the third color sub-pixel, and the fourth color sub-pixel are red, green, blue, and white respectively.

Optionally, the colors of the first color sub-pixel, the second color sub-pixel, the third color sub-pixel, and the fourth color sub-pixel are blue, white, red, and green respectively.

Optionally, the three-color pixel display panel or the four-color pixel display panel includes a plurality of source wirings and a plurality of gate wirings crisscrossed; one the pixel unit is disposed near each intersection of each gate wiring and each source wiring; the driver includes a source driver and a gate driver, and the gate driver drives the plurality of gate wirings one by one to control the pixel unit corresponding to each gate wiring to be activated one by one; the source driver receives image data, and transmits the corresponding image data through the source wiring when each gate wiring is driven, so as to drive the three-color pixel display panel or the four-color pixel display panel to display an image.

Optionally, the number of the source wirings is the same as the number of the gate wirings.

Optionally, the three-color pixel display panel or the four-color pixel display panel further includes a memory for storing image data temporarily.

Optionally, the memory is a static random access memory.

Optionally, when the source driver transmits the received image data to the source wiring to drive the pixel unit, the image data transmitted by the source wiring generates a reflow current at an instant of switching a signal polarity, and the reflow current reflows to the gate driver through the gate wiring.

Optionally, the three-color pixel display panel or the four-color pixel display panel further includes a current regulator adjusting a driving current on the source wiring to adjust the reflow current of the gate driver, so that a driving voltage difference output by a driving chip in the plurality of gate drivers is reduced.

Optionally, according to the image data, when a voltage difference between any two adjacent source wirings of the source wirings is greater than a preset value, the current regulator reduces the driving current on the source wiring so as to reduce the reflow current of the gate driver.

The above objects, features and advantages of the present invention will become more apparent by describing in detail embodiments thereof with reference to the accompanying drawings.

BRIEF DESCRIPTION OF THE DRAWINGS

To illustrate the technical solutions according to the embodiments of the present invention or in the prior art more clearly, the accompanying drawings for describing the embodiments or the prior art are introduced briefly in the following. Apparently, the accompanying drawings in the following description are only some embodiments of the present invention, and persons of ordinary skill in the art can derive other drawings from the accompanying drawings without creative efforts.

DETAILED DESCRIPTION OF THE INVENTION

The technical solutions in the embodiments of the present application will be clearly and completely described in the following with reference to the accompanying drawings in the embodiments. It is apparent that the described embodiments are part of the embodiments of the present application, and not all of them. All other embodiments obtained by a person of ordinary skill in the art based on the embodiments of the present application without departing from the inventive scope are the scope of the present application.

Figure 1:
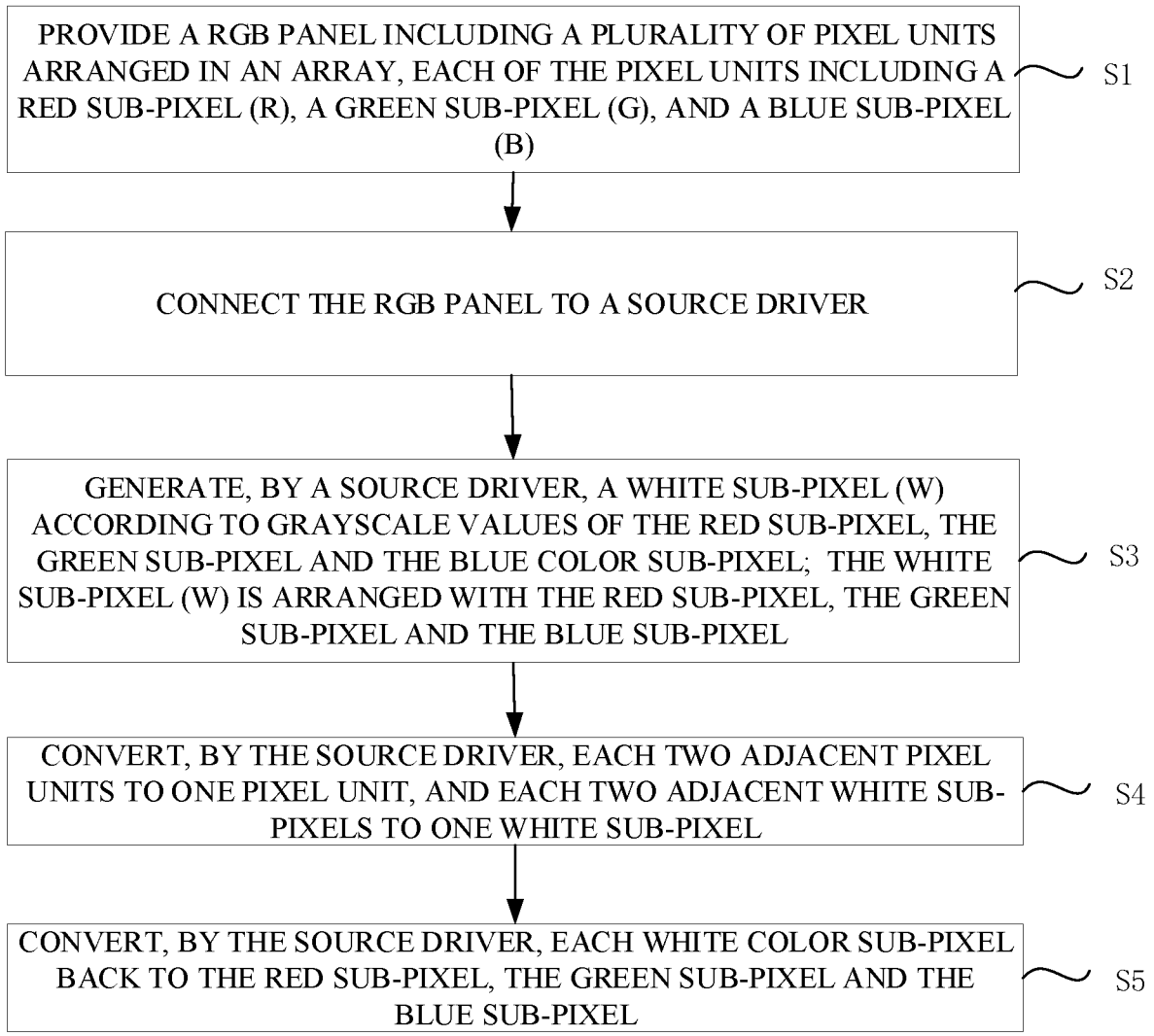
FIG. 1 is a flow diagram illustrating steps of a method for driving a three-color and four-color pixel display panel according to an embodiment of the present application.

Please refer to FIG. 1, which is a flow diagram illustrating steps of a method for driving a three-color and four-color pixel display panel according to an embodiment of the present application. As shown in the figure, the method for driving the three-color and four-color pixel display panel includes steps S1 to S5:

Step S1: providing a three-color pixel display panel, the display panel including a plurality of pixel units arranged in an array, each of the pixel units including a first color sub-pixel, a second color sub-pixel, and a third color sub-pixel; in this embodiment, a red sub-pixel (R), a green sub-pixel (G), and a blue sub-pixel (B) are taken as an example, and the three-color pixel display panel is, for example, an RGB panel, but is not limited thereto;

Step S2: connecting the three-color pixel display panel to a source driver;

Step S3: generating, by a driver (e.g., a source driver in this embodiment, but not limited thereto), a fourth color sub-pixel (e.g., a white sub-pixel (W) in this embodiment, but not limited thereto) according to grayscale values of the red sub-pixel, the green sub-pixel and the blue sub-pixel. The white sub-pixel is arranged with the red sub-pixel, the green sub-pixel and the blue sub-pixel to convert the three-color pixel display panel to a four-color pixel display panel (e.g., an RGBW panel). Optionally, grayscale values of the red sub-pixel, the green sub-pixel, and the blue sub-pixel are calculated by using a timing controller. The source driver generates the white sub-pixel based on the grayscale values calculated by the timing controller. Optionally, the generated white sub-pixel is arranged between each two adjacent pixel units of the three-color pixel display panel;

Step S4: converting, by the source driver, each two adjacent pixel units to one pixel unit, and each two adjacent white sub-pixels to one white sub-pixel. This is achieved for example, by using SubPixel Rendering (SPR) algorithm or other suitable algorithms in a concept of color sharing (or color borrowing), thereby reducing the complexity of converting the four-color pixel display panel back to the three-color pixel display panel; and Step S5: converting, by the source driver, each white sub-pixel back to the red sub-pixel, the green sub-pixel and the blue sub-pixel by using the SubPixel Rendering (SPR) algorithm or other suitable algorithms optionally, so as to convert the four-color pixel display panel back to the three-color pixel display panel.

Optionally, the method for driving the three-color and four-color pixel display panel further includes: performing, by a timing controller, a series of data processing operations on the pixel unit, for example, calculating the grayscale value of the red sub-pixel, the green sub-pixel, and the blue sub-pixel to generate an RGBW digital drive signal, and transmitting the obtained RGBW digital drive signal the source driver, and then performing a digital-to-analog conversion to the received RGBW digital drive signal by the source driver (for example, based on the greyscale value generated by the timing controller) to generate the white sub-pixel.

Optionally, the method for driving the three-color and four-color pixel display panel further includes: outputting, by the timing controller, a driving control signal to the driver, so as to control a time point for the source driver to generate the white sub-pixel, and convert the three-color pixel display panel to the four-color pixel display panel, or convert the four-color pixel display panel back to the three-color pixel display panel.

By performing the above steps, the four-color pixel display panel may be realized based on the three-color pixel display panel only by changing the driving circuit configuration of the panel, and the four-color pixel display panel may be converted back to the three-color pixel display panel as necessary, so as to realize the compatible effect with the four-color pixel display panel in the premise that the design of the three-color pixel display panel is maintain unchanged.

Figure 2:
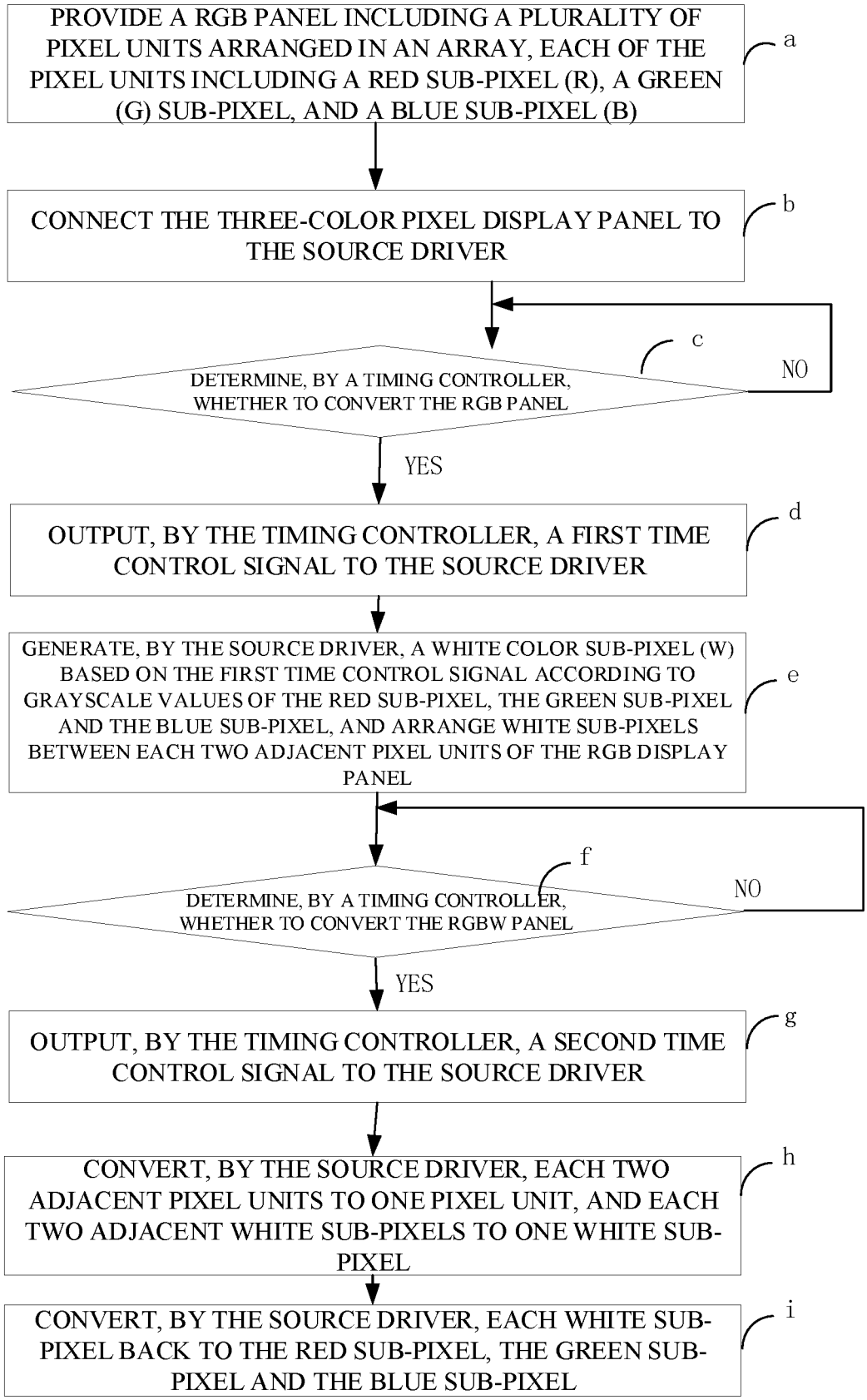
FIG. 2 is a flow diagram illustrating steps of a method for driving a three-color and four-color pixel display panel according to another embodiment of the present application.

Please refer to FIG. 2, which is a flow diagram illustrating steps of a method for driving a three-color and four-color pixel display panel according to another embodiment of the present application. As shown in the figure, the method for driving the three-color and four-color pixel display panel includes steps a~i:

step a: providing the three-color pixel display panel, the display panel including a plurality of pixel units arranged in an array, each of the pixel units including the first color sub-pixel, the second color sub-pixel, and the third color sub-pixel; in this embodiment, the red sub-pixel (R), the green sub-pixel (G), and the blue sub-pixel (B) are taken as an example, and the three-color pixel display panel is, for example, the RGB panel, but is not limited thereto;

step b: connecting the three-color pixel display panel to the source driver;

step c: determining, by a timing controller, whether to convert the three-color pixel display panel at a current time point, if not, not executing the subsequent steps but repeating the step c, and until if yes, executing the subsequent steps;

step d: outputting, by the timing controller, a first driving control signal to the source driver;

step e: generating, by the source driver, a fourth color sub-pixel (e.g., the white sub-pixel (W) is taken as an example in this embodiment) based on the first driving control signal according to grayscale values of the red sub-pixel, the green sub-pixel and the blue sub-pixel, and arranging the fourth color sub-pixels between each two adjacent pixel units of the three-color pixel display panel, so as to convert the three-color pixel display panel (e.g., the RGB panel) to the four-color pixel display panel (e.g., the RGBW panel);

step f: determining, by a timing controller, whether to convert the four-color pixel display panel at the current time point, if not, not executing the subsequent steps but repeating step c, and until if yes, executing the subsequent steps;

step g: outputting, by the timing controller, a second driving control signal to the source driver;

step h: converting, by the source driver, each two adjacent pixel units to one pixel unit, and each two adjacent white sub-pixels to one white sub-pixel based on the second driving control signal; and step i: converting, by the source driver, each white sub-pixel back to the red sub-pixel, the green sub-pixel and the blue sub-pixel, so as to convert the four-color pixel display panel (e.g., the RGBW panel) back to the three-color pixel display panel (e.g., the RGB panel).

By performing the above steps, the four-color pixel display panel may be realized based on the three-color pixel display panel only by changing the driving circuit configuration of the panel, and the four-color pixel display panel may be converted back to the three-color pixel display panel as necessary, so as to realize the compatible effect with the four-color pixel display panel in the premise that the design of the three-color pixel display panel is maintain unchanged.

Figure 3:
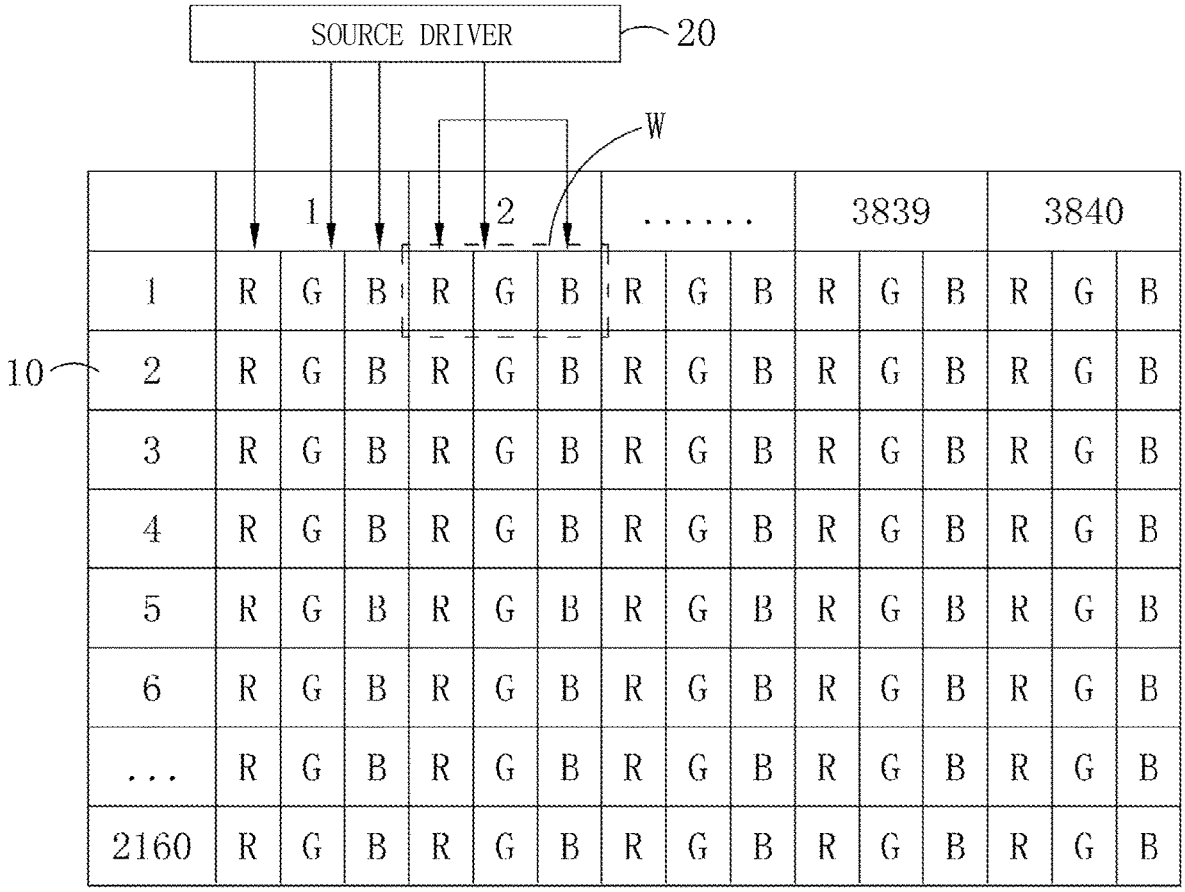
FIG. 3 is a structural schematic diagram of a system for driving a three-color and four-color pixel display panel according to an embodiment of the present application.

Please refer to FIG. 3, which is a structural schematic diagram of a system for driving a three-color and four-color pixel display panel according to an embodiment of the present application. As shown in FIG. 3, the system for driving the three-color and four-color pixel display panel includes a three-color pixel display panel 10 and a source driver 20.

The three-color pixel display panel 10 includes a plurality of pixel units arranged in an array, each pixel unit including the red sub-pixel R, the green sub-pixel G, and the blue sub-pixel B, and the sub-pixels may be sequentially arranged in the above order from left to right in a horizontal direction as in the example shown in FIG. 3. In the case where the three-color pixel display panel 10 is used, the source driver 20 connects the three-color pixel display panel 10 to drive the three-color pixel display panel 10 to display the red sub-pixels R, the green sub-pixels G, and the blue sub-pixels B.

Further, if the four-color pixel display panel is to be used, the source driver 20 may generate the white sub-pixel W according to the grayscale values of the red sub-pixel, the green sub-pixel G, and the blue sub-pixel B. The white sub-pixel W is arranged with the red sub-pixel R, the green sub-pixel G, and the blue sub-pixel B. For example, as shown in FIG. 3, the red sub-pixel R, the green sub-pixel G, the blue sub-pixel B, and the white sub-pixel W are arranged in order from left to right in the horizontal direction. That is, one group consists of one red sub-pixel R, one green sub-pixel G and one blue sub-pixel B, and the white sub-pixel W is between each two groups. Thereby, the three-color pixel display panel 10 can be converted to a four-color pixel display panel.

For example, the three-color pixel display panel and the four-color pixel display panel may be liquid crystal displays (LCD), plasma displays (PDP), organic light-emitting displays (OLED), field emission displays (FED), or other types of displays. This is for illustrative purposes only and is not limited thereto.

Further, if the three-color pixel display panel is to be used again, the source driver 20 may then convert each two adjacent pixel units to one pixel unit, and convert each two adjacent white sub-pixels W to one white sub-pixel. Each white sub-pixel W is then converted back to the red sub-pixel R, the green sub-pixel G and the blue sub-pixel B, so as to convert the four-color pixel display panel back to the three-color pixel display panel 10.

More precisely, the system for driving the three-color and four-color pixel display panel may also optionally include a timing controller connected to the source driver 20 as need, and the timing controller outputs a driving control signal to the source driver 20, so as to control a time point for the source driver 20 to convert the three-color pixel display panel 10 to the four-color pixel display panel or convert the four-color pixel display panel back to the three-color pixel display panel 10.

The pixel display panel described above may be a liquid crystal display panel, an organic light-emitting display panel, an electrophoretic display panel, or a plasma display panel, or other types of panels, which are merely illustrative here and not limited thereto. In addition, those skilled in the art should understand that the size of the panel and the number, color and arrangement of the sub-pixels may be adjusted according to requirements, and are not limited to the embodiments listed in the present application. For example, the red and green colors may actually be used. The three primary colors of red, green and blue may be combined to generate sky blue, magenta and yellow or other colors may be displayed. Furthermore, in the embodiment, the effect of the compatibility between the three-color pixel display panel and the four-color pixel display panel is achieved under the condition that only the driving circuit configuration of the panel is changed, and the source driver 20 may be replaced with other devices for driving the display panel in the peripheral circuit of the aimed panel.

Figure 4:
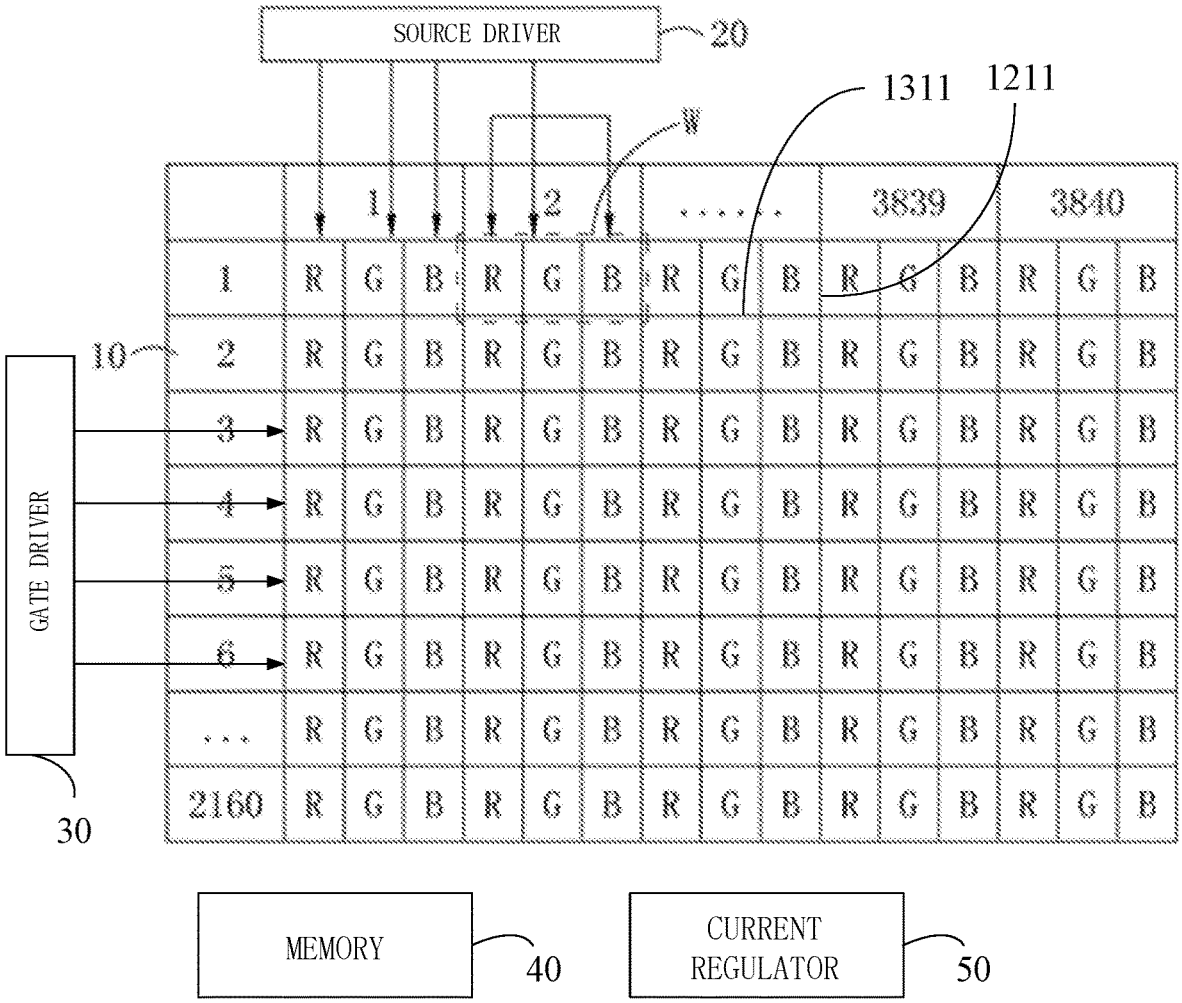
FIG. 4 is a structural schematic diagram of a system for driving a three-color and four-color pixel display panel according to another embodiment of the present application.

Please refer to FIG. 4, which is a structural schematic diagram of a system for driving a three-color and four-color pixel display panel according to another embodiment of the present application. As shown in FIG. 4, the system for driving the three-color and four-color pixel display panel includes a four-color pixel display panel 11, a driver 20, and a plurality of source wirings 1211 and a plurality of gate wirings 1311 crisscrossed. Alternatively, the number of the plurality of source wirings 1211 is the same as the number of the plurality of gate wirings 1311 in this embodiment. The four-color pixel display panel 11 includes a plurality of pixel units arranged in an array. One the pixel unit is disposed near each intersection of each gate wiring 1311 and each source wiring 1211, and each pixel unit includes a red sub-pixel R, a green sub-pixel G, a blue sub-pixel B and a white sub-pixel W.

Comparing to the four-color pixel display panel 11 of the above embodiment of FIG. 3, which is arranged in an order of the red sub-pixel, the green sub-pixel G, the blue sub-pixel B, and the white sub-pixel W, another embodiment shown in FIG. 4 is arranged in a different order, as described in detail below.

The four-color pixel display panel 11 includes a plurality of odd-numbered pixel rows and a plurality of even-numbered pixel rows. In the present embodiment, the red sub-pixel R, the green sub-pixel G, the blue sub-pixel B and the white sub-pixel W in each pixel unit of the plurality of odd-numbered sub-pixel rows of the four-color pixel display panel 11 are arranged in the same order as the red sub-pixel R, the green sub-pixel G, the blue sub-pixel B, and the white sub-pixel W in other pixel units. In addition, the red sub-pixel R, the green sub-pixel G, the blue sub-pixel B, and the white sub-pixel W in each pixel unit of the plurality of even-numbered sub-pixel rows of the four-color pixel display panel 11 are arranged in a same order. However, different from the odd-numbered sub-pixel rows of the four-color pixel display panel 11, which are arranged in the order of the red sub-pixel R, the green sub-pixel G, the blue sub-pixel B and the white sub-pixel W, each pixel unit of the plurality of even-numbered sub-pixel rows is arranged in an order of the blue sub-pixel B, the white sub-pixel W, the red sub-pixel R and the green sub-pixel G.

In more detail, the driver includes a source driver 20 and a gate driver 30. The gate driver 30 drives the plurality of gate wirings 1311 one by one to control the pixel unit corresponding to each gate wiring 1311 to be activated one by one. The source driver 20 receives image data, and transmits the corresponding image data through the source wiring 1211 when each gate wiring is driven, so as to drive the three-color pixel display panel or the four-color pixel display panel to display an image. The image data may be stored temporarily in a memory 40 of the four-color pixel display panel, and the memory 40 is, for example, a static random access memory.

The pixel unit may further include transistors connected to each other as a switching component, a storage capacitor for storing data, and a parasitic capacitance. When the source driver 20 transmits the received image data to the source wiring 1211 to drive the pixel unit, the image data transmitted by the source wiring 1211 generates a reflow current through the parasitic capacitance at an instant of switching a signal polarity, and the reflow current reflows to the gate driver through the gate wiring 1311. In addition, the four-color pixel display panel further comprises a current regulator 50 adjusting a driving current on the source wiring 1211 to adjust the reflow current of the gate driver 30, so that a driving voltage difference output by a driving chip in the plurality of gate drivers 30 is reduced. In fact, for example, when the voltage difference between any two adjacent source wirings 1211 of the source wirings 1211 is greater than a preset value, the current regulator 50 reduces the driving current on the source wiring 1211 so as to reduce the reflow current of the gate driver 30.

Figure 5:
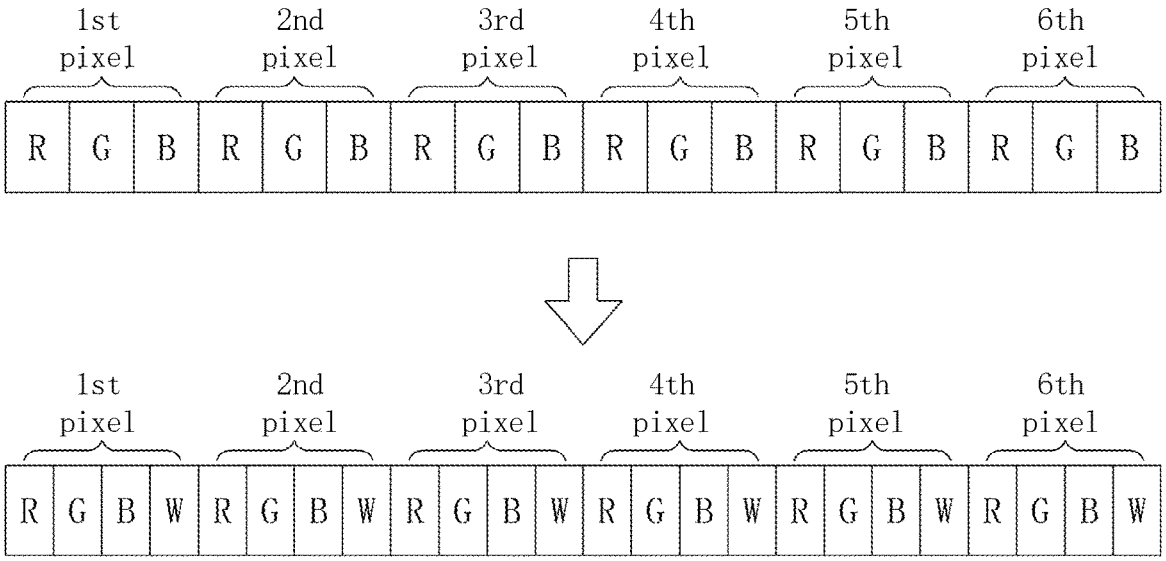
FIG. 5 is a schematic diagram of a mean of converting a three-color pixel display panel to a four-color pixel display panel according to the present application.

Please refer to FIG. 5, which is a schematic diagram of a mean of converting a three-color pixel display panel to a four-color pixel display panel according to the present application. The way of converting the three-color pixel panel to the four-color pixel display panel is described specifically as follows. As shown in the upper part of FIG. 5, the three-color pixel panel includes six pixel units arranged in the horizontal direction, each pixel unit including the red sub-pixel R, the green sub-pixel G, and the blue sub-pixel B. Then referring next to the arrow pointing point shown in FIG. 5, the three-color pixel panel is converted to the four-color pixel display panel including a three-color pixel panel and a plurality of white sub-pixels W. For example, each white sub-pixel W is arranged between a blue sub-pixel B of an adjacent (left) pixel unit and a red sub-pixel R of another adjacent (right) pixel unit, thereby converting an RGB to an RGBW panel is achieved.

Figure 6:
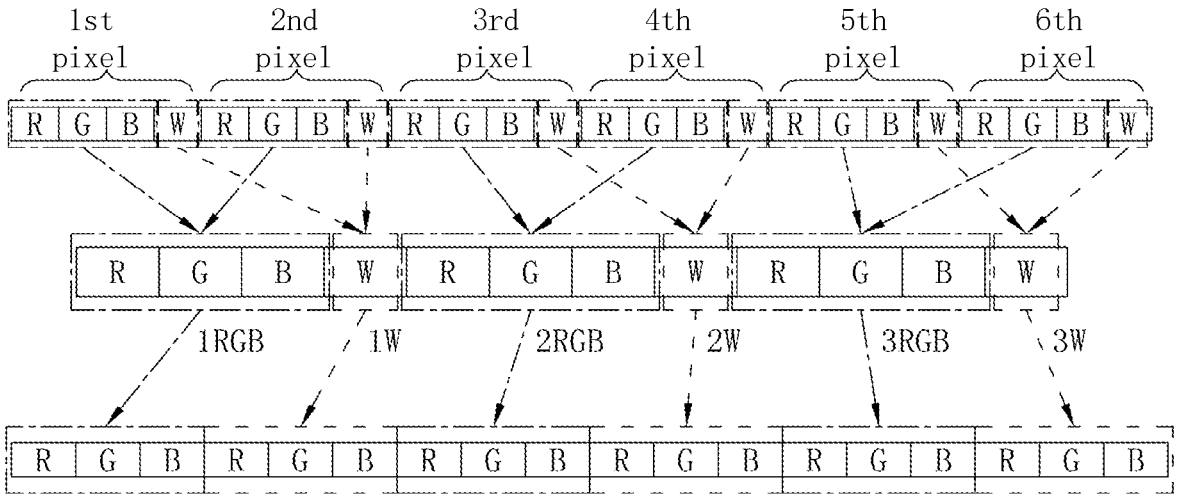
FIG. 6 is a schematic diagram of a mean of converting a four-color pixel display panel to a three-color pixel display panel according to the present application.

Please refer to FIG. 6, which is a schematic diagram of a mean of converting a four-color pixel display panel to a three-color pixel display panel according to the present application. The way of converting the four-color pixel display panel to the three-color pixel panel is described specifically as follows. As shown in the first row of FIG. 6, the four-color pixel display panel includes six pixel units arranged in the horizontal direction, and each pixel unit includes the red sub-pixel R, the green sub-pixel G, the blue sub-pixel B and the white sub-pixel W. Next, as shown in the second row of FIG. 6, the two RGB of the first and second pixel units from the left are converted to one RGB. For example, the red sub-pixel R of the first pixel unit is compressed with the red sub-pixel R of the second pixel unit; the green sub-pixel G of the first pixel unit is compressed with the green sub-pixel G of the second pixel unit; the blue sub-pixel B of the first pixel unit is compressed with the blue sub-pixel B of the second pixel unit; and the white sub-pixel W of the first pixel unit is compressed with the white sub-pixel W of the second pixel unit. In this way, six pixel units are converted (or compressed) to three pixel units. Then, each white sub-pixel W of each pixel unit is converted to a red sub-pixel R, a green sub-pixel G, and a blue sub-pixel B. Finally, the RGBW panel as shown in the first row in FIG. 6 is converted to an RGB panel as shown in the third row in FIG. 6.

The difference between the three-color pixel display panel and the four-color pixel display panel is only that the four-color pixel display panel further includes a white sub-pixel W. Thus, those skilled in the art should understand that except the above difference, the structure, driving manner, and the like of the above-described four-color pixel display panel can be selectively applied to the three-color pixel display panel, and vice versa.

It should be noted that, in the embodiments, the descriptions of the various embodiments are different, and the parts that are not described in detail in a certain embodiment may be referred to the related descriptions of other embodiments.

The foregoing is only a specific embodiment of the present application, but the scope of protection of the present application is not limited thereto, and any equivalents can be easily conceived by those skilled in the art within the technical scope disclosed in the present application. Modifications or substitutions are intended to be included within the scope of the present application. Therefore, the scope of protection of this application should be determined by the scope of the claims.

The invention claimed is:

1. A method for driving a three-color and four-color pixel display panel, comprising:

providing a three-color pixel display panel, the display panel including a plurality of pixel units arranged in an array, each of the pixel units including a first color sub-pixel, a second color sub-pixel, and a third color sub-pixel;

connecting the three-color pixel display panel to a driver;

generating, by the driver, a fourth color sub-pixel according to grayscale values of the first color sub-pixel, the second color sub-pixel and the third color sub-pixel, to convert the three-color pixel display panel to a four-color pixel display panel, wherein the fourth color sub-pixel is arranged with the first color sub-pixel, the second color sub-pixel and the third color sub-pixel and is arranged between each two adjacent pixel units of the three-color pixel display panel;

converting, by the driver, each pair of adjacent pixel units to one converted pixel unit, and converting each pair of fourth color sub-pixels in each pair of adjacent pixel units to one converted fourth color sub-pixel; and converting, by the driver, each fourth color sub-pixel back to the first color sub-pixel, the second color sub-pixel and the third color sub-pixel according to a Sub-Pixel Rendering algorithm, so as to convert the four-color pixel display panel back to the three-color pixel display panel.

2. The method according to claim 1, wherein the step of converting, by the driver, each two adjacent pixel units to one pixel unit, and each two adjacent fourth color sub-pixels to one fourth color sub-pixel comprises using a Sub-Pixel Rendering algorithm.

3. The method according to claim 1, wherein the method further comprises: calculating, by a timing controller, the grayscale value of the first color sub-pixel, the second color sub-pixel and the third color sub-pixel; generating, by the driver, the fourth color sub-pixel according to the grayscale value calculated by the timing controller; and outputting, by the timing controller, a driving control signal to the driver, so as to control a time point for the driver to generate the fourth color sub-pixel, and convert the three-color pixel display panel to the four-color pixel display panel, or convert the four-color pixel display panel back to the three-color pixel display panel.

4. A method for driving a three-color and four-color pixel display panel, comprising:

providing a three-color pixel display panel, the display panel including a plurality of pixel units arranged in an array, each of the pixel units including a first color sub-pixel, a second color sub-pixel, and a third color sub-pixel;

connecting the three-color pixel display panel to a driver;

determining, by a timing controller, whether to convert the three-color pixel display panel at a current time point, if not, repeating this step, and if yes, executing the subsequent steps;

outputting, by the timing controller, a first driving control signal to the driver;

generating, by the driver, a fourth color sub-pixel based on the first driving control signal according to grayscale values of the first color sub-pixel, the second color sub-pixel and the third color sub-pixel, and arranging the fourth color sub-pixels between each two adjacent pixel units of the three-color pixel display panel, so as to convert the three-color pixel display panel to the four-color pixel display panel;

determining, by the timing controller, whether to convert the four-color pixel display panel at a current time point, if not, repeating this step, and if yes, executing the subsequent steps;

outputting, by the timing controller, a second driving control signal to the driver;

converting, by the driver, each pair of adjacent pixel units to one converted pixel unit, and converting each pair of fourth color sub-pixels in each pair of adjacent pixel units to one converted fourth color sub-pixel based on the second driving control signal; and converting, by the driver, each fourth color sub-pixel back to the first color sub-pixel, the second color sub-pixel and the third color sub-pixel according to a Sub-Pixel Rendering algorithm, so as to convert the four-color pixel display panel back to the three-color pixel display panel.

5. A system for driving a three-color and four-color pixel display panel, comprising:

a three-color pixel display panel, including a plurality of pixel units arranged in an array, each pixel unit including a first color sub-pixel, a second color sub-pixel, and a third color sub-pixel; and a driver connecting the three-color pixel display panel, wherein the driver generates a fourth color sub-pixel according to grayscale values of the first color sub-pixel, the second color sub-pixel and the third color sub-pixel to convert the three-color pixel display panel to a four-color pixel display panel; the fourth color sub-pixel is arranged with the first color sub-pixel, the second color sub-pixel and the third color sub-pixel and is arranged between each two adjacent pixel units of the three-color pixel display panel; and the driver then converts each pair of adjacent pixel units to one converted pixel unit, and converts each pair of fourth color sub-pixels in each pair of adjacent pixel units to one converted fourth color sub-pixel; and then the driver converts each fourth color sub-pixel back to the first color sub-pixel, the second color sub-pixel and the third color sub-pixel according to a Sub-Pixel Rendering algorithm, so as to convert the four-color pixel display panel back to the three-color pixel display panel.

6. The system according to claim 5, wherein in the three-color pixel display panel, the first color sub-pixel, the second color sub-pixel, and the third color sub-pixel in the pixel unit of a same row are arranged in a horizontal direction in a same order.

7. The system according to claim 5, wherein the four-color pixel display panel includes a plurality of odd-numbered pixel rows and a plurality of even-numbered pixel rows, and an arranging order of the first color sub-pixel, the second color sub-pixel, the third color sub-pixel and the fourth color sub-pixel in each pixel unit of a plurality of odd-numbered sub-pixel rows of the four-color pixel display panel is different from an arranging order of the first color sub-pixel, the second color sub-pixel, the third color sub-pixel and the fourth color sub-pixel in each pixel unit of a plurality of even-numbered sub-pixel rows of the four-color pixel display panel.

8. The system according to claim 5, wherein in the pixel unit of the four-color pixel display panel, the first color sub-pixel, the second color sub-pixel, the third color sub-pixel, and the fourth color sub-pixel are arranged sequentially in the horizontal direction from left to right.

9. The system according to claim 5, wherein the system further comprises a timing controller connecting the driver, and the timing controller outputs a driving control signal to the driver, so as to control a time point for the driver to convert the three-color pixel display panel to the four-color pixel display panel or convert the four-color pixel display panel back to the three-color pixel display panel.

10. The system according to claim 5, wherein the three-color pixel display panel and the four-color pixel display panel are liquid crystal displays, plasma displays, organic light emitting displays, or field emission displays.

11. The system according to claim 5, wherein the colors of the first color sub-pixel, the second color sub-pixel, the third color sub-pixel, and the fourth color sub-pixel are red, green, blue, and white respectively.

12. The system according to claim 5, wherein the colors of the first color sub-pixel, the second color sub-pixel, the third color sub-pixel, and the fourth color sub-pixel are blue, white, red, and green respectively.

13. The system according to claim 5, wherein the three-color pixel display panel or the four-color pixel display panel includes a plurality of source wirings and a plurality of gate wirings crisscrossed; one the pixel unit is disposed near each intersection of each gate wiring and each source wiring; the driver includes a source driver and a gate driver, and the gate driver drives the plurality of gate wirings one by one to control the pixel unit corresponding to each gate wiring to be activated one by one; the source driver receives image data, and transmits the corresponding image data through the source wiring when each gate wiring is driven, so as to drive the three-color pixel display panel or the four-color pixel display panel to display an image.

14. The system according to claim 13, wherein the number of the source wirings is the same as the number of the gate wirings.

15. The system according to claim 13, wherein the three-color pixel display panel or the four-color pixel display panel further includes a memory for storing image data temporarily.

16. The system according to claim 15, wherein the memory is a static random access memory.

17. The system according to claim 13, wherein when the source driver transmits the received image data to the source wiring to drive the pixel unit, the image data transmitted by the source wiring generates a reflow current at an instant of switching a signal polarity, and the reflow current reflows to the gate driver through the gate wiring.

18. The system according to claim 17, wherein the three-color pixel display panel or the four-color pixel display panel further comprises a current regulator adjusting a driving current on the source wiring to adjust the reflow current of the gate driver, so that a driving voltage difference output by a driving chip in the plurality of gate drivers is reduced.

19. The system according to claim 18, wherein, according to the image data, when a voltage difference between any two adjacent source wirings of the source wirings is greater than a preset value, the current regulator reduces the driving current on the source wiring so as to reduce the reflow current of the gate driver.

* * * * *